US006554674B1

(12) United States Patent
Thorne, III

(10) Patent No.: US 6,554,674 B1
(45) Date of Patent: Apr. 29, 2003

(54) WATER-SKIMMING DISC

(76) Inventor: Edwin Thorne, III, 410 Monroe Dr., Palo Alto, CA (US) 94306

( * ) Notice: Subject to any disclaimer, the term of this patent is extended or adjusted under 35 U.S.C. 154(b) by 0 days.

(21) Appl. No.: 09/573,435

(22) Filed: May 16, 2000

Related U.S. Application Data

(60) Provisional application No. 60/150,755, filed on Aug. 26, 1999.

(51) Int. Cl.[7] ..... A63H 27/00
(52) U.S. Cl. ..... 446/46; 473/588
(58) Field of Search ..... 446/153, 46, 47, 446/48; 473/588

(56) References Cited

U.S. PATENT DOCUMENTS

| | | | | | |
|---|---|---|---|---|---|
| 12,801 | A | * | 5/1855 | Von Kammerhueber | 473/588 |
| 2,864,201 | A | * | 12/1958 | Leise | 473/588 |
| 3,544,113 | A | * | 12/1970 | Hand | 473/588 |
| 3,900,987 | A | * | 8/1975 | Holt | 473/588 |
| 4,151,997 | A | | 5/1979 | Glovak et al. | 273/106 B |
| 4,395,046 | A | | 7/1983 | Cosmopulos | 273/424 |
| 4,463,954 | A | | 8/1984 | Panse et al. | 273/424 |
| 4,979,922 | A | | 12/1990 | Clark | 446/46 |
| 5,522,780 | A | * | 6/1996 | Roddy | 473/588 |
| 5,679,082 | A | | 10/1997 | Hincke | 473/588 |
| 5,836,840 | A | | 11/1998 | Bustamante et al. | 473/588 |
| 5,984,753 | A | * | 11/1999 | Perez | 446/46 |
| 6,174,214 | B1 | * | 1/2001 | Cooper | 446/46 |

* cited by examiner

*Primary Examiner*—Derris H. Banks
*Assistant Examiner*—Urszula M Cegielnik
(74) *Attorney, Agent, or Firm*—Carr & Ferrell LLP

(57) ABSTRACT

A gliding or flying hydrodynamic disc designed for recreational use upon and across a surface of water is provided. The disc is circular with a peripheral circular trough on the top surface to provide a grip for a user. The bottom of the disc contains a circular flat section to provide minimum drag and maximum hydrodynamic performance. The outer rim of the disc is rounded and extends above the planar surface of the disc to provide increased aerodynamics to keep the disc on the surface of the water and improve gliding duration.

12 Claims, 3 Drawing Sheets

WATER-SKIMMING DISC

CROSS-REFERENCES TO RELATED APPLICATIONS

This application claims the benefit of Provisional patent application Ser. No. 60/150,755, filed on Aug. 26, 1999, entitled Underwater Flying Disc, which is incorporated herein by reference.

BACKGROUND OF THE INVENTION

1. Field of the Invention

This invention relates to throwing discs for recreational use, and more specifically to a water-skimming disc for use in a swimming pool, lake or ocean.

2. Description of Related Art

There are many toys and recreational devices on the market for use in and around swimming pools and other bodies of water. Recreational throwing discs for skimming or skipping across bodies of water have been known for many years, much like skipping flat stones across water. A well-known toy or recreational device used out of water is the flying saucer device. Such devices are tossed from one user to another, exploiting their aerodynamic aspects to enable them to glide from the thrower to the catcher through the air. However, due to their emphasis on aerodynamic design, such flying saucer devices are not adapted towards skimming or skipping over bodies of water. In addition, most flying saucer devices are manufactured with rigid material that can injure people or damage property upon impact.

U.S. Pat. No. 5,836,840 to Bustamante (1998) discloses a hydroplaning disc designed to skip or skim over water; however, the design of this disc is complex and expensive to manufacture.

Several other types of water skimming or skipping devices have been proposed. Examples are U.S. Pat. No. 4,979,922 to Clark (1990), 4,463,954 to Panse, et al. (1984), 4,395,046 to Cosmopulos (1983), and 4,151,997 to Glovak (1979). However, none of these can easily skip off a body of water. U.S. Pat. No. 5,679,082 to Hincke (1997) is heavy and likely expensive to manufacture.

SUMMARY OF THE INVENTION

It is the general object of the present invention to provide a lightweight disc that is easily gripped and designed to safely and efficiently skim or skip upon and across the surface of a body of water, such as a pool or the ocean, from one user to another. The invention is a hydrodynamic disc that, in one embodiment, includes a central circular core of a solid construction with a predetermined diameter and height that tapers to an outer edge. The circular core includes a softer flexible material along the edge and radially inward a short distance along the top and bottom surfaces to provide a gripping surface and safety protection to disc users.

The bottom surface includes a center bulge that tapers to a thinner outer edge and has a flat circular bottom, giving the disc efficient hydrodynamic qualities that allow it to easily skip across a body of water.

The present invention provides for a multitude of gripping means at any point along its top surface.

The simple design of the present invention provides enhanced safety to a user, hydrodynamic efficiency, is lightweight and inexpensive to manufacture.

BRIEF DESCRIPTION OF THE DRAWINGS

The present invention may be better understood, and its numerous features and advantages made apparent to those skilled in the art, by referencing the accompanying drawings. For ease of understanding and simplicity, common numbering of elements within the illustrations is employed where the same element is in different drawings.

DESCRIPTION OF THE PREFERRED EMBODIMENTS

Figure 1:
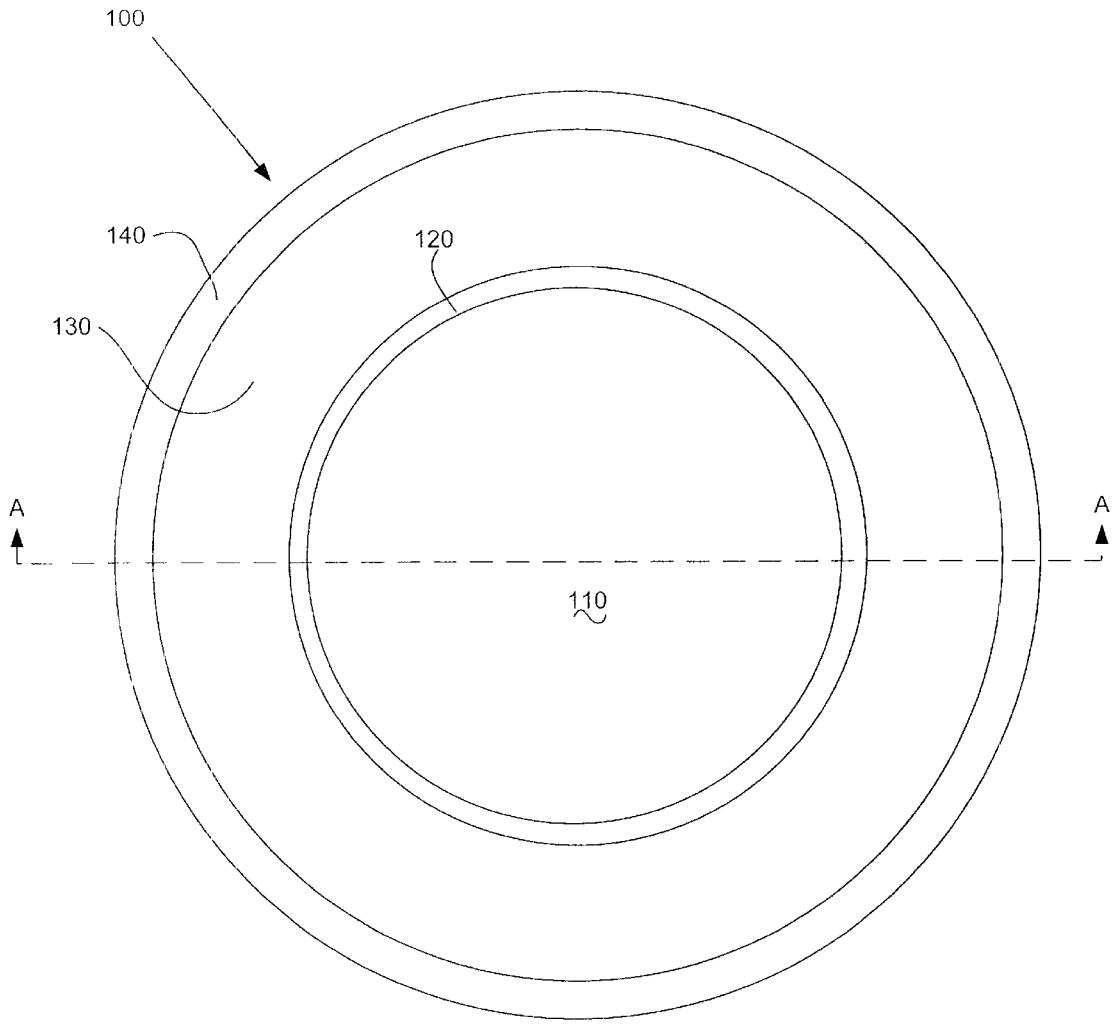
FIG. 1 is a top plan view of a water-skimming disc incorporating the principles of the invention.

FIG. 1 is a top view of a water-skimming disc 100 that has an overall shape of a generally circular disc. Disc 100 includes at its center a circular core section 110 surrounded concentrically by an annular overlap section 120, a cupped rim section 130, and an outside lip section 140. The overall diameter of disc 100 is preferably about 6½ inches, but could be in the range between 1½ inches and 12 inches to accommodate users of various ages and skills.

The circular core section 110 on the top of the water-skimming disc 100 is preferably about 4¼ inches in diameter and has an exposed flat surface except for about ¼-inch along the outer periphery of the circular core section, which is covered by the annular overlap section 120.

The cupped rim 130 is a smoothly contoured trough with a textured surface that provides a grip to help a user to maintain adequate control when tossing the disc.

A raised surface of the outside lip section 140 further enhances the user's grip on the water-skimming disc 100. Most flying saucer or flying disc toys have rounded edges that slope downward. The upward sloping rounded edge of the outside lip section 140 enables the disc 100 to skip off the surface of a body of water, rather than to dive through the surface and come to an abrupt halt as would most other flying saucer or disc toys. The shape of the outside lip section 140 not only allows the water-skimming disc 100 to glide on the surface of the water, but the aerodynamics of the outside lip section 140 create lift that keeps the disc on the water's surface, rather than flying up.

Figure 2:
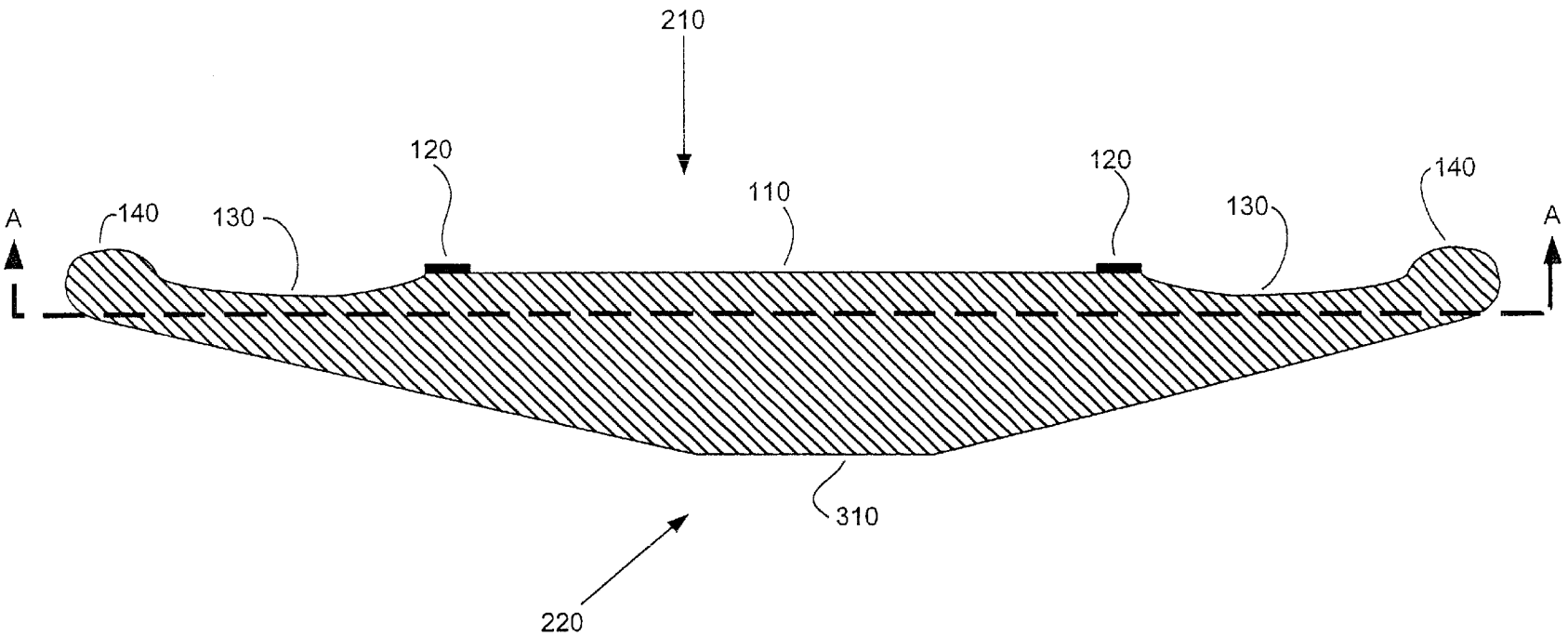
FIG. 2 is a cross-sectional view in the direction of lines A—A through the water-skimming disc of FIG. 1.

FIG. 2 is a cross sectional view showing the water-skimming disc 100 to be generally disc-shaped with a large width-to-height ratio. A top surface 210 shows the upper contours of the disc 100, including the circular core section 110, the annular overlap section 120, the cupped rim section 130, and the outside lip section 140. FIG. 2 also shows the contoured radius of the cupped rim section 130 and the raised edge of the outside lip section 140. The water-skimming disc 100 has a bottom surface 220 that is substantially elliptical or conical. In the center of the bottom surface 220 is a skimming plane 310. The skimming plane 310 is preferably flat and circular, with a diameter of approximately one inch. Designing the bottom surface 220 with the substantially flat skimming plane 310 at its center gives the water-skimming disc 100 increased hydroplaning capabilities over that of purely elliptical or conical shaped discs. The disc 100 will therefore glide over the water surface faster and for longer distances. The entire bottom surface 220 is smooth to reduce friction.

Figure 3:
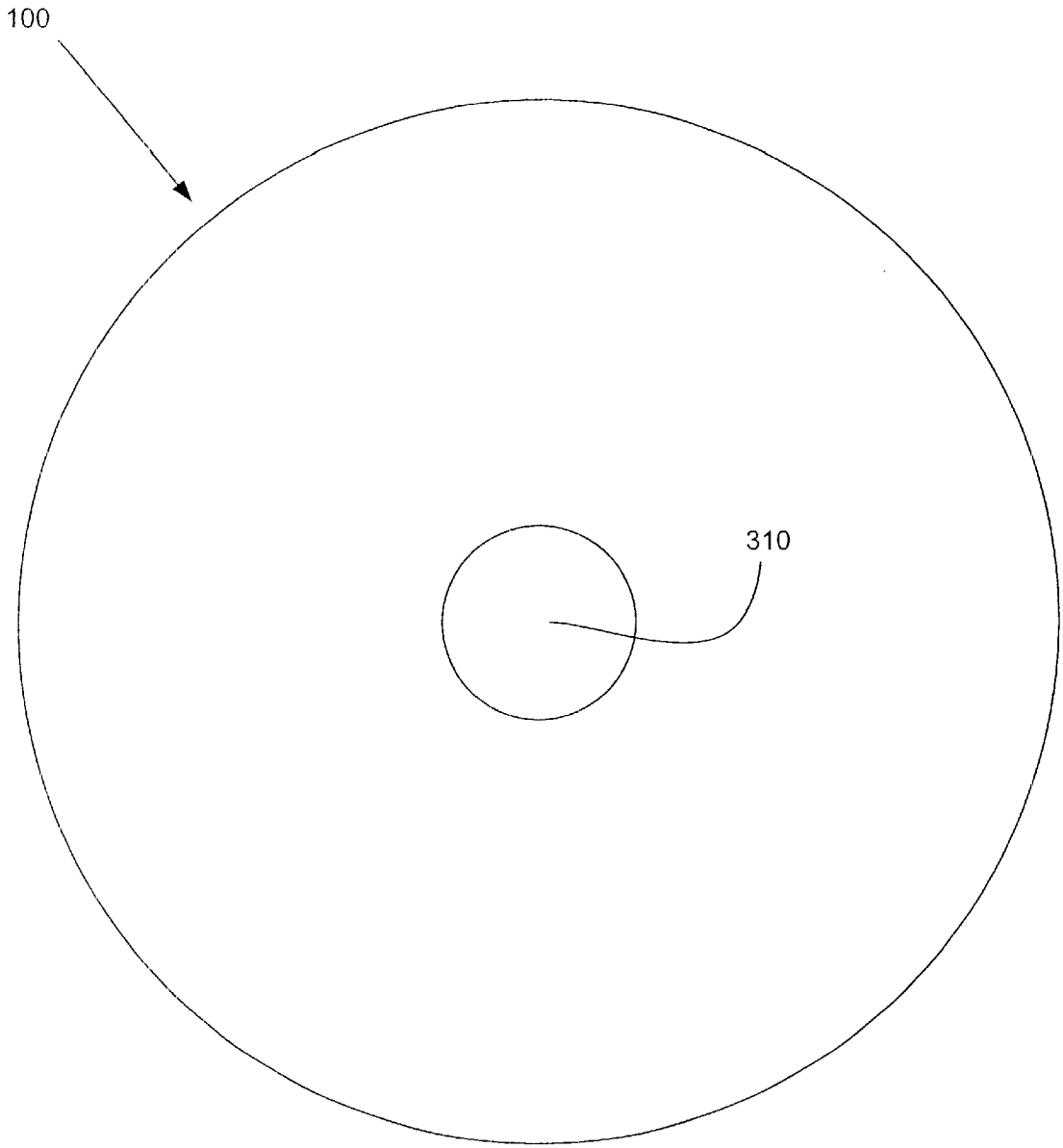
FIG. 3 is a bottom plan view of the water-skimming disc of this invention.

FIG. 3 shows a bottom view of the water-skimming disc 100. The skimming plane 310 is preferably about 1¼ inches in diameter.

Referring again to FIG. 2, the thickness between the top of the circular core section 110 and the bottom of the skimming plane 310 (see FIG. 3) is preferably about ¾ inch or 18 mm. The disc is preferably a monolithic structure, with the material comprising the annular overlap section 120, the cupped rim section 130, the outside lip section 140 and the bottom surface 220 being contiguous. Alternate embodiments may have a rigid core and flexible outer edge for improved performance.

While the preferred embodiment of the water-skipping disc 100 has a solid core of polyurethane foam with a density of 0.3 (relative to water), other embodiments could include other suitable materials with a density in the range from 0.1 to 2.0. The water-skimming disc 100 can be made either more or less dense than water, allowing a wide range of weights, skipping characteristics, speeds and distances.

The optimal weight for the water-skimming disc 100 is 3 ounces; however, other embodiments may weigh as little as two ounces and as much as 6 ounces.

The water-skimming disc 100 is launched by hand, and will operate properly only with the top surface 210 facing up. This orientation also allows the hydrodynamic design of the bottom surface 220 and the skimming plane 310 to interact with the surface of a body of water (for example, a pool, a lake or the ocean) upon which a user throws the water-skimming disc 100. The shape of top surface 210 allows the user to grip the water-skimming disc 100 preferably by placing a thumb inside the cupped rim 130 and placing the outside lip 140 between the thumb and forefinger, with the other fingers supporting the bottom of the water-skimming disc. With the water-skimming disc 100 in a user's hand, the user would move his or her arm holding the water-skimming disc in a backhand motion across his/her body, away from the body, and nearly parallel to the surface of the body of water towards another user who is either in, or on the other side of, the body of water. As the user's hand passes in front of the user's body, the user releases his/her grip on the water-skimming disc and the weight of the disc and its forward motion causes the disc to glide towards the other user, skipping off the surface of the water one or more times like a flat rock. The hydrodynamic shape of the bottom surface 220 of disc 100 allows the disc to skip smoothly across the water to the other user, who can then catch the disc in his/her hand. The catcher can then launch the water-skimming disc 100 back to the thrower in the same manner. Users may find their own methods of launching the water-skimming disc 100 across water, resulting in any number of skips and in a variety of speeds and directions.

As preferred embodiments of the present invention are described above with reference to the aforementioned drawings, various modifications or adaptations of the methods and or specific stuctures described may become apparent to those skilled in the art. All such modifications, adaptations, or variations that rely upon the teachings of the present invention, and through which these teachings have advanced the art, are considered to be within the spirit and scope of the present invention. Hence, these descriptions and drawings are not be considered in a limiting sense as is understood that the present invention is in no way limited to the embodiments illustrated.

What is claimed is:

1. A water skimming disc comprising:

a solid central core, the central core being substantially circular;

a top surface, incorporated with and partially overlapping the central core, the top surface being substantially circular and further including:

an annular channel at its radial periphery, and an annular outer rim;

a bottom surface, joined to the top surface at the annular outer rim, the bottom surface being substantially circular with a substantially ellipsoidal cross-section; and a skimming plane disposed on the bottom surface, the skimming plane being flat and substantially circular, with a diameter less than that of the bottom surface and positioned concentric to the bottom surface.

2. The water skimming disc of claim 1 wherein the central core a made of a material that is buoyant in water.

3. The water skimming disc of claim 1 further comprising a gripping means disposed along the annular channel of the top surface of the disc.

4. The water skimming disc of claim 1 wherein the central core, the top surface and the bottom surface are integrated together and are formed from a single piece of material.

5. A water skimming disc comprising:

a central core, the central core being substantially circular;

a top surface, incorporated with and partially overlapping the central core, the top surface being substantially circular and further including:

an annular channel at its radial periphery, and an annular outer rim having an outside edge that is rounded and upward sloping to provide lift to the disc, the rim extending above the planar surface of the central core;

a bottom surface, joined to the top surface at the annular outer rim, the bottom surface being substantially circular with a substantially ellipsoidal cross-section; and a skimming plane disposed on the bottom surface, the skimming plane being flat and substantially circular, with a diameter less than that of the bottom surface and positioned concentric to the bottom surface.

6. The water skimming disc of claim 5 wherein the central core is made of a material that is buoyant in water.

7. The water skimming disc of claim 5 further comprising a gripping means disposed along the annular channel of the top surface of the disc.

8. The water skimming disc of claim 5 wherein the central core, the top surface and the bottom surface are integrated together and are formed from a single piece of material.

9. A water skimming disc comprising:

a solid, substantially circular central core;

a top surface, incorporated with and partially overlapping the central core, the top surface being substantially circular and further including an annular channel at its radial periphery, and an annular outer rim; and a bottom surface, joined to the top surface at the annular outer rim, the bottom surface being substantially elliptical and including a flat circular bottom center portion with a diameter less than that of the bottom surface and positioned concentric to the bottom surface.

10. A water skimming disc comprising:

a solid, substantially circular central core;

a top surface, incorporated with and partially overlapping the central core, the top surface being substantially circular and further including an annular channel at its radial periphery, and an annular outer rim having an edge with a rounded, upward sloping, convex shape to improve grip and enhance water-skimming functionality; and a bottom surface, joined to the top surface at the annular outer rim, the bottom surface being substantially elliptical and including a flat circular bottom center portion with a diameter less than that of the bottom surface and positioned concentric to the bottom surface.

11. A water skimming disc comprising:

a solid substantially circular central core;

a top surface including an annular channel at its radial periphery, and an annular outer rim having an edge with a rounded convex shape, the edge being upward sloping; and a bottom surface being substantially elliptical and convex and having an elliptical portion joined to the annular outer rim of the top surface with a junction having a surface of a convex shape.

12. A water skimming disc comprising:

a solid central core, the central core being substantially circular and having a flat surface on a top side;

a top surface, incorporated with the solid central core, the top surface being substantially circular and further including the flat surface of the solid central core;

an annular channel at its radial periphery, and an annular outer rim having an edge with a rounded convex shape, the edge is upward sloping, the surface of the outer rim is textured to provide a grip; and a bottom surface, joined to the top surface at the annular outer rim, the bottom surface being substantially elliptical and convex and including an elliptical portion and a flat circular bottom center portion with a diameter less than that of the bottom surface and positioned concentric to the bottom surface, the elliptical portion is joined to the outer rim with a junction having a surface of a convex shape.

* * * * *